United States Patent [19]

Vincent et al.

[11] 4,080,942

[45] Mar. 28, 1978

[54] METERING FUEL BY COMPRESSIBILITY

[75] Inventors: Edward T. Vincent, Boca Raton, Fla.; George E. Cheklich, Bloomfield Hills, Mich.

[73] Assignee: The United States of America as represented by the Secretary of the Army, Washington, D.C.

[21] Appl. No.: 699,140

[22] Filed: Jun. 23, 1976

[51] Int. Cl.[2] ..... F02M 47/02

[52] U.S. Cl. ..... 123/139 AT; 123/139 AS

[58] Field of Search ..... 123/139 AT, 139 AK, 123/139 AS, 32 JV

[56] References Cited

U.S. PATENT DOCUMENTS

| | | | |
|---|---|---|---|
| 1,701,089 | 2/1929 | von Salis | 123/139 AS |
| 2,347,363 | 4/1944 | Palumbo | 123/139 AT |
| 2,420,550 | 5/1947 | Miller | 123/139 AT |
| 3,516,395 | 6/1970 | Bassot et al. | 123/139 AK |
| 3,990,422 | 11/1976 | Watson et al. | 123/139 AT |

*Primary Examiner*—Charles J. Myhre
*Assistant Examiner*—Tony M. Argenbright
*Attorney, Agent, or Firm*—Peter A. Taucher; John E. McRae; Nathan Edelberg

[57] ABSTRACT

A piston engine timed fuel injection system wherein highly compressed fuel, e.g. at 20,000 p.s.i., is temporarily stored in a chamber isolated from the pressure source. A flow valve is opened to permit part of the stored fuel to expand into the combustion space. Spring force closes the valve while the injection pressure is relativey high, e.g. about 3000 p.s.i. Fuel injection pressure at beginning of the injection period may be very high, e.g. 20,000 p.s.i., thereby promoting improved fuel atomization, shorter ignition delay, lower rate of pressure rise in the combustion space, smoother combustion, and lower peak pressure in the combustion chamber. By injecting fuel from an "isolated" chamber it is possible to accurately limit the quantity in accordance with compressibility factors.

5 Claims, 4 Drawing Figures

METERING FUEL BY COMPRESSIBILITY

The invention described herein may be manufactured, used, and licensed by or for the Government for governmental purposes without payment to us of any royalty thereon.

BACKGROUND AND SUMMARY OF THE INVENTION

The invention contemplates an engine fuel injector comprising an internal needle valve having a tip that opens or closes a flow path leading to the combustion space. The other end of the needle valve communicates with a control chamber that at times is pressurized by the fuel pressure source; control chamber pressure exerts an axial force on the needle that opposes the force on the needle provided by the fuel in the main flow path.

A spring is arranged to bias the needle valve to a closed position when both the main flow path and control chamber are pressurized to the maximum flow. When the control chamber is depressurized the spring is unable to hold the needle valve closed; fuel pressures at the tip area of the needle move it to the open condition. By alternately pressurizing or depressurizing the control chamber it is possible to rapidly close or open the flow path leading to the combustion space.

The "balancing" action produced by the pressurized control chamber enables the fuel flow path to be highly pressurized without premature opening of the needle valve. Therefore the initial flow of fuel into the combustion space is at high pressure, with consequent advantages relative to finer atomization of the fuel. The biasing spring establishes a low pressure cut-off that prevents unduly low injection pressure near the end of the injection period.

In a preferred embodiment of the invention the fuel flow path comprises a pressurizable fuel storage chamber. After the initial pressurization of the storage chamber volume by completion of the pump delivery stroke, the pressurized chamber is automatically isolated from the fuel pressure source (pump); the pump then begins its suction stroke, and a check valve confines the retained volume under pressure for injection into the cylinder. As fuel is ejected from the storage chamber the fuel pressure at the discharge orifice is reduced so that the valve-closing spring is able to produce a rapid shut-off action without undue opposition from the flowing fuel.

THE DRAWINGS

FIG. 1 diagrammatically illustrates one form of a needle-actuation feature used in the invention.

Figure 4:
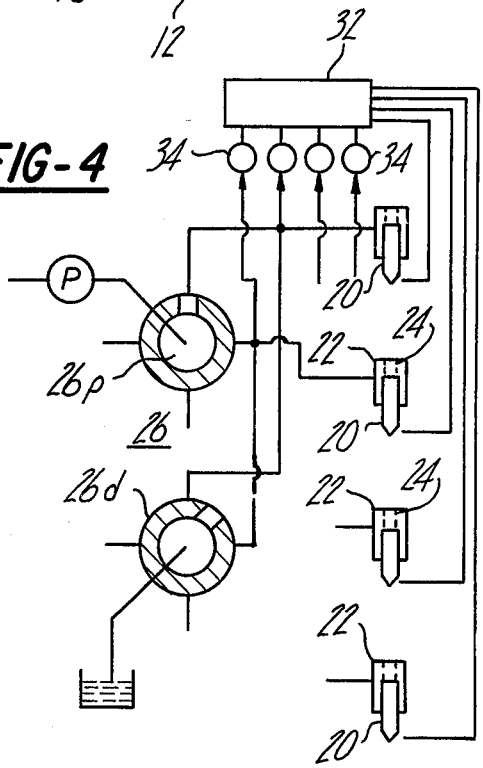

FIG. 4 diagrammatically illustrates an alternative embodiment of the invention.

FIG. 1

Figure 1:
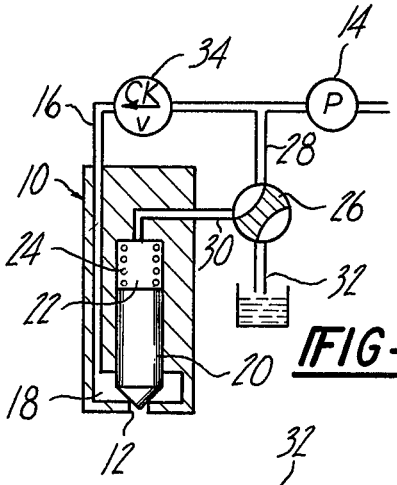

FIG. 1 diagrammatically illustrates a liquid fuel injector 10 having a discharge orifice 12 adapted to spray diesel fuel, gasoline, kerosene, etc. into the combustion space of an internal combustion engine (not shown). A pump 14 initially delivers pressurized fuel through line 28, valve 26, annd line 30, into chamber 22 within the injector. Fuel is also delivered to injector chamber 18 via line 16 and check valve 34. The invention contemplates relatively high pressures within chambers 18 and 22 in the neighborhood of 20,000 p.s.i. or higher, (or lower).

In the illustrated condition of the injector a needle valve or plunger 20 closes orifice 12 in spite of the pressurized condition of chamber 18. The needle closing force is provided by the same high pressures existing within a control chamber 22, plus the additive force developed by a compression spring 24.

The effective area of the needle valve at its lower end is only slightly less than the effective area of the needle valve at its upper end, the area difference being that of orifice 12 which is small when compared to the total needle cross section area. Liquid pressure forces at the lower and upper ends of the needle tend to balance or neutralize one another so that the only effective biasing force is that provided by compression spring 24. The system is thus suited to use high pressures, e.g. 20,000 p.s.i. and up, in line 16 without danger that such pressures will prematurely force the needle valve open.

When valve 26 is rotated approximately one quarter revolution line 30 connects with a drain port 48, thereby depressurizing chamber 22. The force then acting on the upper end of needle 20 is only the comparatively small force due to spring 24. Accordingly the pressure within chamber 18 is able to lift the needle valve away from orifice 12, thereby enabling the pressurized fuel to flow from chamber 18 through orifice 12 into the combustion space.

Fuel flow through orifice 12 will continue until spring 24 force acting on the top of needle 20 overcomes the force due to fuel pressure in chamber 18 acting on the bottom of needle 20, thus moving the needle valve 20 to the closed condition.

It will be seen that the operating cycle for the injector mechanism is controlled by valve 26. This valve is engine-programmed or timed to produce a fuel-injection operation at the desired point in the engine cycle. The quantity of fuel injected into the combustion space is determined by the volume of fuel delivered by pump 14 under compressibility, as governed by engine demand.

FIG. 2

Figure 2:
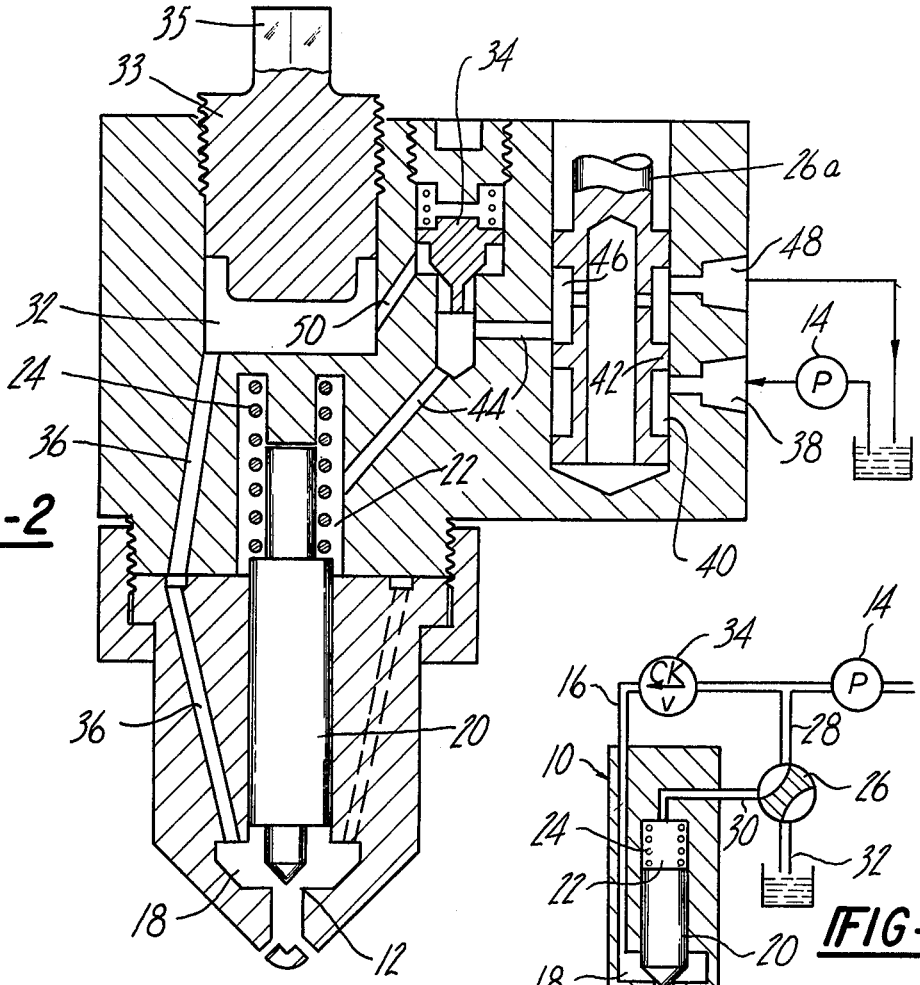
FIG. 2 illustrates a liquid compression feature and in the invention.

FIG. 2 illustrates a preferred embodiment of the invention having a "compressed liquid" operational feature. The FIG. 2 structure incorporates a fuel storage chamber 32 that is at times isolated from control chamber 22 by a check valve 34; pressurized fuel trapped in chamber 32 in subsequently reexpanded and expelled through orifice 12. In the illustrated condition of the mechanism fuel is discharged from chamber 32 through a passage 36 to chamber 18 at the lower end of needle valve 20. The high fuel pressure in chamber 18 is effective to move the needle valve upwardly away from orifice 12 when chamber 22 is vented by valve 26a, thereby enabling fuel to flow through orifice 12 to the combustion space.

The upper end of needle 20 forms one surface of a control chamber 22 that alternately communicates with a fuel pressure source or drain, depending on the adjusted position of a reciprocatory shuttle valve 26a. In the illustrated condition of valve 26a, the control chamber 22 communicates with the drain so that chamber 22 is depressurized.

Shuttle valve 26a is driven in synchronism with the engine; the valve performs essentially the same function as valve 26 shown in FIG. 1. Pressurized fuel is supplied through a port 38 to a valve relief area 40. Land area 42 prevents flow to a passage 44 that communicates with the underside of check valve 34. Passage 44 also communicates with chamber 22. Passage 44 can be drained through a valve relief area 46 and drain port 48.

Upward movement of shuttle valve **26*a* causes land 42 to move upwardly beyond passage 44, thereby enabling pressurized fuel to flow from port 38 through relief area 40 and passage 44 into control chamber 22. Fuel also flows from passage 44 upwardly past check valve 34 into duct 50 leading to chamber 32. This action pressurizes both chambers 32 and 22 without producing flow through orifice 12**.

Return movement of valve **26*a* to its illustrated position causes control chamber 22 to be depressurized through a path that comprises line 44, relief area 46 and drain port 48. Check valve 34 prevents backflow from chamber 32 into line 44. A depressurized condition of chamber 22 permits the chamber 18 pressure to open valve 20, thereby enabling a measured fuel quantity to be delivered through orifice 12** to the combustion space.

LIQUID COMPRESSION

The quantity of liquid discharged through orifice 12 (FIG. 2) is related to the volume of chamber 32, the bulk modulus of elasticity of the liquid, and the pressure change experienced by the liquid between initial opening of valve 20 and final closure of the valve. One possible system contemplates a pressure change in the neighborhood of 17,000 p.s.i., derived from a crack-open pressure of 20,000 p.s.i. and a final pressure of 3,000 p.s.i. The final pressure is a function of the spring 24 force; as the pressure in chamber 18 drops to around 3,000 p.s.i. spring 24 "overpowers" the pressure to close the valve. Quantity of fuel injected into the combustion space depends on engine load demand. It can be varied by variation of the 20,000 p.s.i. pressure.

It will be appreciated that in the FIG. 2 system the quantity of fuel injected into the combustion space is largely unaffected by timing errors. For a given size chamber 32 the fuel quantity is a function largely of the initial and final pressures, which are independent of the timing. The timing does however effect or determine when the liquid is injected.

Injected fuel quantity may be determined or estimated from the following equation:

$$K = (\Delta P/\Delta V) \times V$$

where K is the bulk modulus of elasticity of the liquid fuel, $\Delta P$ is pressure change experienced during the injection period, V is the volume of chambers 32 and 18, and passages 36 and 50; and $\Delta V$ is quantity of fuel discharged through orifice 12.

Figure 3:
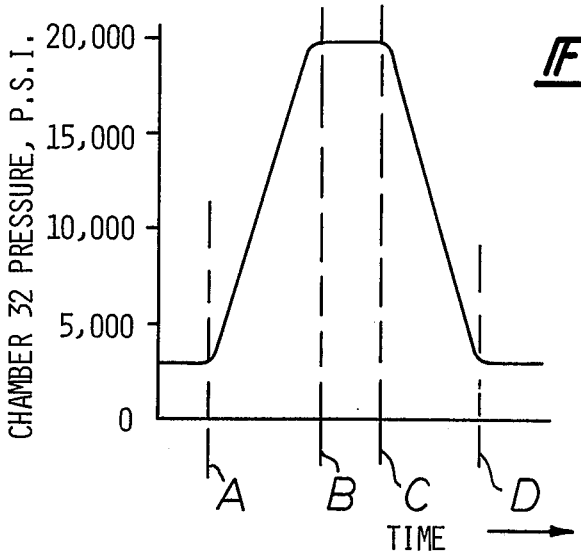
FIG. 3 is a chart depicting one mode of operation of the FIG. 2 structure.

FIG. 3 depicts pressure performance of the FIG. 2 system. At time A valve 26 is moved up to begin pressurizing chambers 22 and 32. At time B chamber 32 and chamber 22 become fully pressurized at the value dictated by the supply system, in this case 20,000 p.s.i. At time C valve **26*a* is moved down to depressurize chamber 22 and start the injection of fuel into the combustion space. At time D the chamber 18 pressure is approximately 3,000 p.s.i., which is low enough to enable spring 24 to close needle 20 against orifice 12**.

VARIABLE INJECTION VOLUMES

When the engine is operating at high load conditions it is desired to inject a relatively large fuel quantity into the combustion space; at lighter loads the injected quantity is less. The injected quantity can be varied by varying the "high" pressure; i.e. adjusting pump pressure or pressure regulator to a system setting of say 10,000 p.s.i. instead of 20,000 p.s.i. However this method of quantity control lowers the injection pressure and thus could adversely affect fuel atomization.

Another method of controlling the injection quantity is to vary the size of chamber 32 by the device shown or other similar devices. The devices shown in FIG. 2 includes a threaded plug 33 equipped with an actuator extension 35. A device responsive to engine load or speed may be connected to actuator 35 to turn plug 33 in or out, thereby varying the volume of chamber 32. By varying chamber 32 volume, rather than injection pressure, it is possible to achieve economical light load operation without sacrificing high injection pressure and fine fuel atomization. If the "variable-volume" control concept should be difficult to implement into hardware the concept using pressure control could be used to vary injection volume for different load conditions.

The bulk modulus of elasticity K for the liquid (previously mentioned) varies with temperature. Therefore it may be desirable to include a temperature compensating mechanism in the load-responsive device used to operate the volume control actuator 35.

FIG. 4

The device shown in FIG 2. contemplates that each fuel injector will have its own compressed-liquid storage chamber 32. If desired, a single compressed liquid storage chamber can be used for a plurality of separate injectors as shown diagrammatically in FIG. 4. In brief, the rotary barrel **26*p* of distributor valve 26 selectively distributes fuel pressure to individual control chambers 22 for the individual injector needles 20. At the same time the pressure is communicated to a single storage chamber 32 via branch lines containing check valves 34; springs 24 hold the individual valves 20 closed as before. Valve 26 is shown as a rotary valve; other suitable valve means could be used. The valve includes two barrel sections 26*p* and 26*d*; barrel section 26*p* connects to the pump, whereas barrel section 26*d* connets to the drain. At one point in time barrel section 26*p* pressurizes a given one of the injector valves; at a later instant barrel section 26*d* connects the respective chamber 22 to drain, thereby allowing the pressure below the respective valve tip to open that valve. The operation is similar to that of the FIG. 2 construction. Use of a single common chamber 32** for all injectors may have some advantages in ensuring equal injection volumes to all cylinders of the engine, and it may have space or cost advantages as well.

ADVANTAGES OF THE INVENTION

A major advantage of this invention is that injection pressure is high at the start of the injection period (when valve 20 initially opens). The high injection pressure promotes fine atomization of the fuel, better startability and shorter ignition delay. Less unburnt fuel accumulates in the cylinder before combustion. The pressure rise due to combustion occurs at a slower rate so that combustion is smoother with reduced peak cylinder pressure and probably longer engine life. High pressure at start of ignition and short ignition delay are believed to be features of this invention.

Another feature of this invention is the control of injected quantity. The FIG. 2 "compressed liquid" system delivers metered quantities that are largely unaffected by timing variables. The quantity is determined by the pressure differential between the relatively high starting pressure (e.g. 20,000 p.s.i.) and the relatively low ending pressure (e.g. 3,000 p.s.i.). The ending pressure is controlled by spring 24, and is thus independent of the timing. Similarly the variable starting pressure is a function of the system pressure, not timing.

Spring 24 can be selected to give a reasonably high ending injection pressure, e.g. 4,000 p.s.i. The ending pressure is not as critical as the starting pressure because the fuel is then mixing into an already established flame.

A further feature of the invention is the injection volume adjustment provided by plug 33. This feature enables very small quantities of fuel to be injected at high pressure, thereby permitting the engine to have a very low idle speed and a wider operating speed range. This could reduce drive train (transmission) requirements necessary to meet given output speed-load ranges.

We wish it is to be understood that we do not desire to be limited to the exact details of construction shown and described for obvious modifications will occur to other persons skilled in the art.

We claim:

1. In an engine fuel supply system comprising a fuel pump (14) and drain (48): an improved fuel injector mechanism comprising housing means forming a control chamber (22) and a fuel injection chamber (18) having a discharge orifice (12); a slidable needle valve (20) having a first end area exposed to the control chamber and a second end area exposed to the injection chamber, the end areas of the needle valve being approximately the same so that forces attributable to fuel pressure have negligible biasing effect on the valve when the control chamber and injection chamber are fully pressurized; spring means (24) biasing the needle valve in a direction wherein its second end areas closes the discharge orifice when both of the aforementioned chambers are pressurized; means defining a rigid nonelastic fuel storage chamber (32) continuously connected to the injection chamber; a first flow passage (44) within the housing means continuously connected to the aforementioned control chamber (22); an engine-programmed valve (26a) movable within the housing means to alternately connect the first flow passage (44) to the fuel pump or the drain; a second passage (50) connecting the aforementioned storage chamber to the first flow passage; and a check valve (34) in said second passage permitting flow from the first passage to the storage chamber but preventing backflow from the storage chamber to the first passage; the engine-programmed valve (26a) having a first position wherein pressurized fuel from the pump is delivered through the first passage (44) to the control chamber (22) and second passage (50), for thereby filling the fuel storage chamber (32) and injection chamber (18) with pressurized fuel; the spring means (24) being effective to bias the needle valve (20) to a position closing the discharge orifice (12) when said engine-programmed valve is in its first position; said engine-programmed valve having a second position wherein pressurized fuel is exhausted from the control chamber (22) through the first passage (44) to the drain (48), whereby the control chamber pressure is reduced to enable the injection chamber pressure to move the needle valve to a position opening the discharge orifice; the spring means developing a substantial force for thereby closing the needle valve while the injection chamber pressure is appreciably above atmospheric, whereby the time at which the needle valve closes is determined by pressure rather than the engine-programmed valve.

2. In the system of claim 1: said storage chamber being defined by a cavity in the housing means and a plug (33) adjustably mounted in the cavity for movement to adjust the storage chamber volume.

3. In the system of claim 2: the further improvement wherein said plug (33) is threaded into the cavity so that axial adjustment of the plug is produced by rotational forces imparted to the plug.

4. In the system of claim 3: said plug having an actuator extension (35) located externally of the housing means to adapt the plug for adjustment while the engine is running.

5. In the system of claim 1: said engine-programmed valve consisting of a spool-type shuttle valve having axially spaced flow passages (40 and 46) adapted to selectively communicated said first passage (44) with the pump or drain.

* * * * *